US007677211B2

(12) United States Patent
Patel et al.

(10) Patent No.: US 7,677,211 B2
(45) Date of Patent: Mar. 16, 2010

(54) SINGLE HYDRAULIC CIRCUIT MODULE FOR DUAL LIFT OF MULTIPLE ENGINE VALVES

(75) Inventors: Vimesh M. Patel, Novi, MI (US); Timothy L. Neal, Ortonville, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 299 days.

(21) Appl. No.: 11/669,619

(22) Filed: Jan. 31, 2007

(65) Prior Publication Data

US 2008/0178828 A1 Jul. 31, 2008

(51) Int. Cl.
*F01L 9/02* (2006.01)

(52) U.S. Cl. ..... 123/90.12; 123/90.11; 123/90.44; 123/193.3; 251/129.22; 277/596

(58) Field of Classification Search ..... 123/90.11, 123/90.12, 90.13, 90.39, 90.44, 90.45, 90.46, 123/90.48, 90.52, 90.55, 193.3, 193.5; 251/129.15, 251/192.22; 277/591, 596
See application file for complete search history.

(56) References Cited

U.S. PATENT DOCUMENTS

| | | | | |
|---|---|---|---|---|
| 5,839,400 | A * | 11/1998 | Vattaneo et al. | 123/90.16 |
| 6,196,175 | B1 | 3/2001 | Church | 123/90.16 |
| 6,584,942 | B1 | 7/2003 | Albertson et al. | 123/90.16 |
| 6,584,951 | B1 | 7/2003 | Patel et al. | 123/198 |
| 6,684,836 | B2 * | 2/2004 | Inoue | 123/90.17 |
| 6,769,387 | B2 | 8/2004 | Hayman et al. | 123/90.39 |
| 6,948,463 | B2 * | 9/2005 | Mischker et al. | 123/90.12 |

* cited by examiner

*Primary Examiner*—Ching Chang
(74) *Attorney, Agent, or Firm*—Quinn Law Group, PLLC.

(57) ABSTRACT

A single hydraulic circuit module is provided for controlling valve lift at multiple cylinders in an engine. The single module includes a housing that at least partially forms a supply passage and a control passage. The supply passage is in fluid communication with the fluid supply and the control passage is in fluid communication with the feed passage. At least one solenoid valve is provided and supported by the housing positioned between the supply passage and the control passage. The solenoid valve is controllable to vary fluid flow from the supply passage to the control passage to permit adjustment of hydraulic lift assemblies to vary lift of engine valves in response to control of the solenoid valve.

13 Claims, 4 Drawing Sheets

SINGLE HYDRAULIC CIRCUIT MODULE FOR DUAL LIFT OF MULTIPLE ENGINE VALVES

TECHNICAL FIELD

The present invention relates to a single hydraulic circuit module attachable to a cylinder head of an engine for hydraulically controlling engine valve lift at multiple cylinders.

BACKGROUND OF THE INVENTION

Engine valve actuator assemblies for engines such as an internal combustion engine on a motor vehicle typically have a roller finger follower that contacts an engine valve and is pivotable in response to cam motion to lift the valve. A typical roller finger follower can be replaced by a hydraulically controlled switchable roller finger follower ("SRFF"). A hydraulically controlled SRFF, which is also referred to herein as a hydraulic lift assembly, can provide two distinct engine valve lifts. Hydraulic control of the SRFF may be designed to achieve a low lift and a high lift of the engine valve or may be designed such that a low lift is zero lift, or results in valve deactivation. An alternative hydraulic lift assembly can include hydraulically controlled switchable hydraulic lifter valves that provide two levels of engine valve lift through a push rod, as is known by those skilled in the art.

Traditionally, such variations in engine valve lift have been achieved by using a cylinder head that has a complex system of fluid supply passages that enable pressurized fluid to communicate with the hydraulic lift assemblies, which are supported in the cylinder head. Cylinder heads with such an integrated hydraulic system are necessarily specific to each engine family and entail numerous production steps such as casting, boring, and finishing the network of channels provided in the cylinder head.

U.S. Pat. No. 6,584,951 issued Jul. 1, 2003 to Patel, et. al and commonly assigned to General Motors Corporation, discloses an engine assembly that requires a separate individual hydraulic circuit module for each engine cylinder which achieves selective deactivation of each cylinder in accordance with the hydraulic controls provided within the cylinder module associated with the cylinder. The cylinder modules of the '951 patent utilize a solenoid valve to selectively block oil flow from a flow channel to an exit port of the module and thereby build oil pressure in the flow channel and in lifter openings of each collapsible hydraulic lifter valve associated with each cylinder. The oil pressure actuates the collapsible lifters to enable cylinder deactivation. The solenoid valve can also be controlled to permit the flow, thus causing the hydraulic lift assembly to cause reciprocal lifting and lowering (i.e., opening and closing) of the engine valve (i.e., actuating the cylinder). Thus, each solenoid valve acts as a two-way on/off valve.

SUMMARY OF THE INVENTION

It is desirable to reduce hydraulic control system complexity and allow packaging flexibility while providing dual valve lift and/or engine valve deactivation capability for a specific engine. An apparatus is provided which functions as a single hydraulic circuit module that permits valve lift control of multiple engine valves in response to hydraulic controls within the hydraulic circuit module. The single hydraulic circuit module may be applied to an overhead cam-type engine or a pushrod-type valve gear train. The single hydraulic circuit module controls valve lift of multiple cylinders, and preferably of multiple sets of cylinders, thereby reducing the number of components required to enable variable valve lift and minimizing packaging concerns in comparison with systems requiring a separate hydraulic circuit module and/or separate hydraulic circuit integrated within the cylinder head for each individual cylinder.

Specifically, the single hydraulic circuit module is for an engine assembly having a cylinder head that at least partially forms a plurality of cylinders and supports at least one hydraulic lift assembly for each of the cylinders. The cylinder head is in fluid communication with a hydraulic fluid supply such as the supply gallery of an engine block attached below the cylinder head. The single hydraulic circuit module includes a solenoid valve and a housing that supports the solenoid valve. The housing at least partially forms a fluid supply passage and a control passage. The solenoid valve is positioned between the passages and is controllable to vary the volume (and therefore the pressure) of fluid flow from the fluid supply passage to the control passage. The housing is configured for attachment to the cylinder head so that the fluid supply passage is in fluid communication with the fluid supply gallery and the control passage is in fluid communication with hydraulic lift assemblies for a first set of the cylinders. Control of the solenoid valve thereby allows the hydraulic lift assemblies for the first set of cylinders to be controlled to a low lift or a high lift position, corresponding with the volume of fluid flow permitted by the solenoid valve. The low lift position may be a zero-lift position resulting in cylinder deactivation.

Preferably, the apparatus includes a second solenoid valve supported by the housing, in which case the housing at least partially forms a second control passage and the second solenoid valve is positioned between a supply passage and the second control passage. The second solenoid valve is controllable to vary fluid flow and pressure from the fluid supply passage to the second control passage. The second control passage is in fluid communication with hydraulic lift assemblies of the second set of cylinders when the housing is attached to the cylinder head. Thus, different sets of cylinders may be controlled to achieve variable lifts independently from one another. The ability to control different sets of engine valves independently solves issues caused by engine timing. The engine valves are timed such that the various cylinders are at different points in the combustion cycle. It is not advantageous to switch from a higher valve lift to a lower valve lift, or from a lower valve lift to a higher valve lift, during certain points of the combustion cycle. For instance, the switch may more highly stress the engine valve train components or cause unacceptable audible noise during some points of the cycle. The single hydraulic circuit module can control engine valve lift through hydraulic control of sets of hydraulic lift assemblies at different sets of the cylinders independently of one another, thus allowing the switch in valve lift to be accomplished at an optimal point in the combustion cycle for each cylinder set.

In one aspect of the invention, the housing of the single hydraulic circuit module forms separate chambers each configured to receive one of the solenoid valves. The supply passage and the control passages may each include a channel formed on an outer surface of the housing and an aperture extending through the channel that is in fluid communication with a fluid supply (in the case of the supply passage) and the chamber (in the case of each respective control passage).

Various features may be provided within the apparatus including a filter positioned in the supply passage upstream of the solenoid valve to filter debris that may otherwise affect valve performance. Additionally, a gasket may be provided that circumscribes the fluid supply channel and the control passage(s) for sealing the apparatus when it is attached to the cylinder head. Furthermore, a weep channel may be formed on the surface of the housing to circumscribe the fluid supply passage and the control passage(s). The weep channel is circumscribed by the gasket. Thus, any fluid seeping out of the fluid communication between the module and the cylinder head will be collected in the weep channel. Preferably, a drain passage is provided in the cylinder head opposite the weep channel to allow drain back to the fluid supply.

The single hydraulic circuit module can provide hydraulic control for dual valve lift of intake valves and/or exhaust valves associated with the respective cylinders. Separate feed passages are provided in the cylinder head that are in fluid communication with the first and second control passages when the module is attached to the cylinder head. The first feed passage provides control fluid to hydraulic lift assemblies at the first set of cylinders and the second feed passage provides control fluid to hydraulic lift assemblies at the second set of cylinders. The first and second sets of cylinders may be associated with a single overhead camshaft. For instance, the first set and the second set may all be intake valves operatively connected with an intake camshaft or may all be exhaust valves operatively connected with an exhaust camshaft. Alternatively, the first and second sets of cylinders may be associated with two overhead camshafts, such as an intake camshaft and an exhaust camshaft. In this instance, the single hydraulic circuit module may control hydraulic lift at intake and exhaust valves of the first set of cylinders, or at intake and exhaust valves at the second set of cylinders.

Flexible packaging is possible due to the minimal packaging space required by a single hydraulic circuit module. For instance, the single hydraulic circuit module may be attached to the cylinder head between adjacent ones of the cylinders, such as between adjacent spark plug towers and the intake and exhaust camshafts. For other engine families, the module may be mounted on the rear of the cylinder head, i.e., on the rear side thereof.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
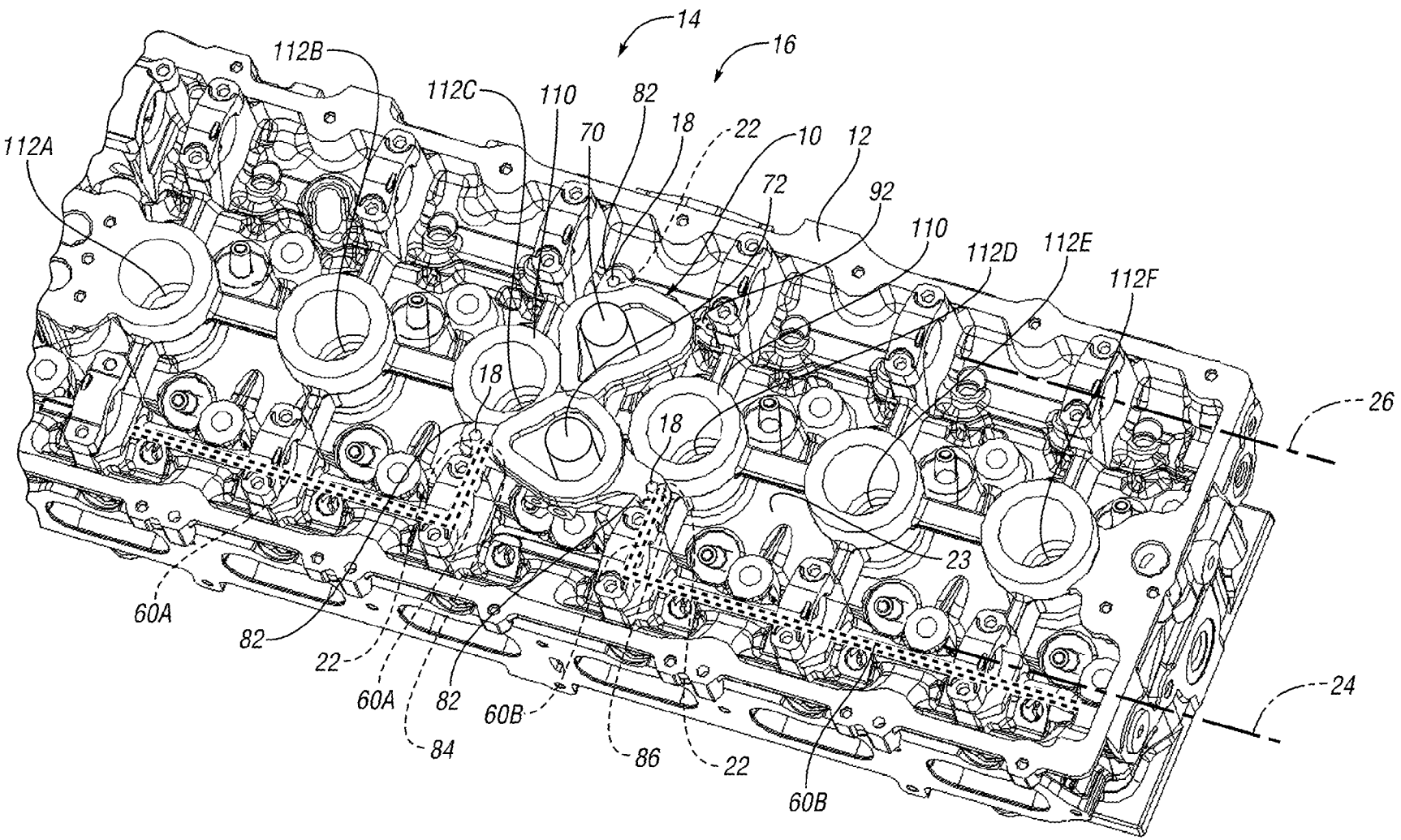
FIG. 1 is a schematic perspective illustration of a portion of an engine assembly having a first embodiment of a single hydraulic circuit module attached at an outer surface of the cylinder head.

Referring to FIG. 1, a single hydraulic circuit module 10 is attached to a cylinder head 12 of a cylinder head assembly 14 which represents a portion of an engine assembly 16. The single hydraulic circuit module 10 is attached with three bolts 18 received through three respective fastener openings 20 (two shown in FIG. 2) and through corresponding mating engine openings 22 to secure the module 10 to an outer surface 23 of the cylinder head 12.

The engine assembly 16 is an overhead cam-type with a separate inlet camshaft and exhaust camshaft (not shown in FIG. 1 but inlet camshaft shown in FIG. 3) for lifting and lowering of inlet valves and exhaust valves, respectively. The inlet camshaft rotates about inlet camshaft axis 24 and the exhaust camshaft rotates about exhaust camshaft axis 26. The single hydraulic circuit module 10 is configured to control inlet valves at multiple cylinders. As will be explained herein, module 10 controls a first set of inlet valves separately from a second set of inlet valves. Although in the embodiment shown, the module 10 controls inlet valves, it may alternatively control exhaust valves by providing a cylinder head with fastener openings 20 and mating engine openings 22 repositioned so that the module 10 is rotated 180 degrees with respect to its position in FIG. 1 and can operatively connect to exhaust valves aligned with the exhaust camshaft axis 26.

Figure 3:
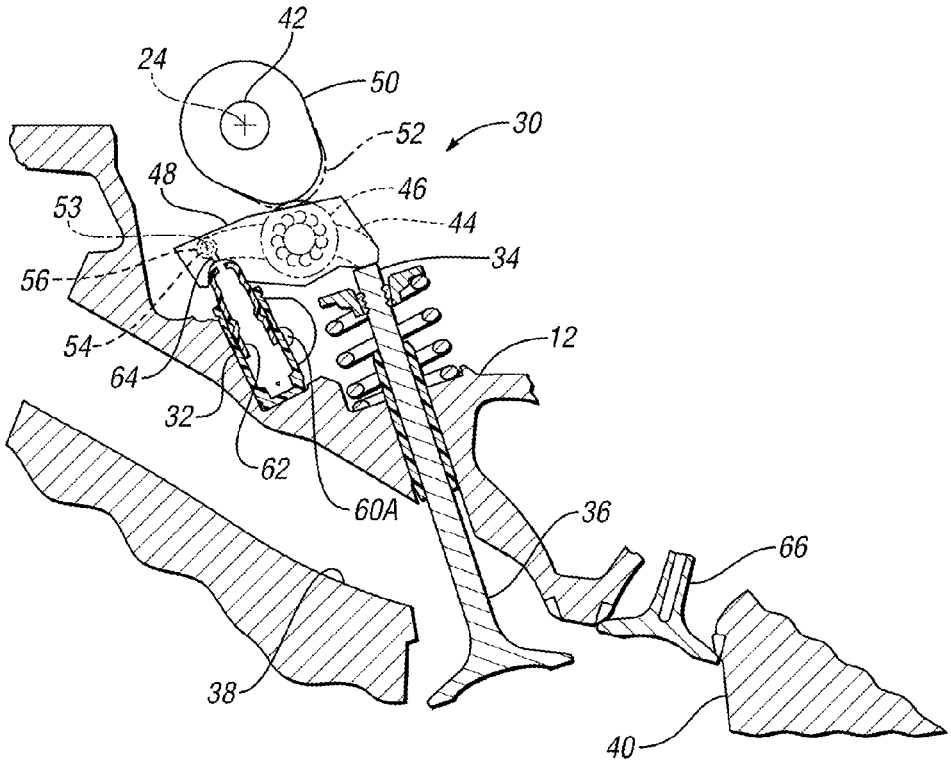
FIG. 3 is a schematic side illustration of a hydraulic lift assembly having a hydraulic lash adjuster and an engine valve and hydraulically controllable by the single hydraulic circuit module of either FIG. 1 or 4.

Referring to FIG. 3, control of an engine valve to provide dual lift will be briefly described. FIG. 3 illustrates a hydraulic lift assembly 30, also referred to as an SRFF assembly supported by the cylinder head 12. The SRFF assembly 30 is pivotally mounted on a hydraulic lash adjuster 32, and contacts the valve stem 34 of an engine inlet valve 36 that selectively opens and closes an inlet passage 38 to a cylinder 40 partially formed by the cylinder head 12. The engine inlet valve 36 is selectively lifted and lowered in response to rotation of an inlet camshaft 42 on which multiple cam lobes are mounted. The inlet camshaft 42 rotates about inlet camshaft axis 24.

The SRFF assembly 30 includes an inner rocker arm 44 which rotatably supports a roller element 46. The inner rocker arm 44 is positioned between outer rocker arms 48, one of which is visible. The other outer rocker arm 48 is positioned on the opposite side of the inner rocker arm 44 and is configured exactly like the rocker arm 48 visible in FIG. 3. A first low lift cam lobe 50 rotates with the camshaft 42 and is in operative contact with the roller element 46 mounted on the inner rocker arm 44. The inner rocker arm 44 is in contact with the valve stem 34. The inner and outer rocker arms 44, 48 are both pivotable about an axis through pivot point 53. The arms 44, 48 may selectively be pivotable relative to one another or connected together for common pivoting about pivot point 53. High lift is provided by selectively pinning the inner arm 44 and the outer arm 48 together for common pivoting about pivot point 53. When the inner rocker arm 44 pivots freely with respect to the outer rocker arm 48, action of the high lift cam lobe 52 on the outer rocker arm 48 does not affect lift of the engine inlet valve 36. Instead, the high lift cam lobe 52 simply causes the outer rocker arm 48 to move relative to the inner rocker arm 44 about the pivot point 53 in "lost motion" without any impact on the lift event of the engine inlet valve 36. Rather, lift of the engine inlet valve 36 is affected only by action of the low lift cam lobe 50 on the roller element 46 as transferred to the engine inlet valve 36 via the inner rocker arm 44, which contacts the valve stem 34.

When high valve lift is desired, the outer rocker arm 48 may be connected for common pivoting with the inner rocker arm 44. When this occurs, the effect of the high lift cam lobe 52 on the outer rocker arm 48 is transferred to the inner rocker arm 44 and to the engine inlet valve 36. Switching between the low lift and high lift event is affected by controlling the hydraulic pressure fed through the hydraulic lash adjuster 32. The hydraulic lash adjuster 32 is in fluid communication with a pin 54 transversely mounted with respect to the arms 44 and 46 at an axis through pivot point 53. During a low lift event, a relatively low pressure of hydraulic fluid is fed through feed passage 60 to a chamber 62 formed within the hydraulic lash adjuster 32. The feed passage 60 is formed or machined within cylinder head 12. The chamber 62 is in fluid communication with a channel 64 which acts upon an inner transverse surface of the pin 54. The relatively low pressure is insufficient to actuate the pin 54 outward to be received within a pin bore 56 formed in the outer rocker arm 48. When high valve lift is desired, an electronic control unit (not shown) controls the single hydraulic circuit module 10 of FIGS. 1 and 2 to increase hydraulic fluid pressure provided in feed passage 60 thereby increasing pressure on the pin 54 sufficiently to actuate it outward to lock the inner rocker arm 44 to the outer rocker arm 48. A hydraulic lift assembly such as assembly 30 is discussed in further detail in U.S. Pat. No. 6,769,387, issued Aug. 3, 2004 to Hayman et al., commonly assigned to General Motors Corporation, which is hereby incorporated by reference in its entirety.

Operation of the single hydraulic circuit module 10 to vary the hydraulic fluid pressure within the feed passage 60 is described below. It should be noted, that the lift control provided by the control module 10 as described with respect to the engine inlet valve 36 may also be applied to an exhaust valve such as the exhaust valve 66 shown in FIG. 3. It should also be appreciated that the second embodiment of a single hydraulic circuit module shown and described with respect to FIGS. 4 through 6 herein also operates to control fluid pressure in a similar feed passage in fluid communication with engine valves as described with respect to the SRFF assembly 30, hydraulic lash adjuster 32 and engine inlet valve 36 of FIG. 3. Although a SRFF assembly 30 having inner and outer rocker arms 44, 48 selectively connectable for common pivoting is described in FIG. 3, other types of hydraulic lift assemblies which are hydraulically controlled to allow variable valve lift may also be employed within the scope of the invention. For instance, the single hydraulic circuit module described herein may also be utilized with respect to a push rod-type engine in which a pin within a hydraulic lash adjuster is selectively engaged to control valve lift. The dual valve lift, i.e., the low lift and the high lift events, may be such that the low lift event is zero lift, resulting in cylinder deactivation. For instance, a controllable hydraulic lash adjuster to provide cylinder deactivation is described with respect to a push rod-type engine in U.S. Pat. No. 6,584,951, issued Jul. 1, 2003 to Patel et. al and commonly assigned to General Motors Corporation, which is hereby incorporated by reference in its entirety.

Figure 2:
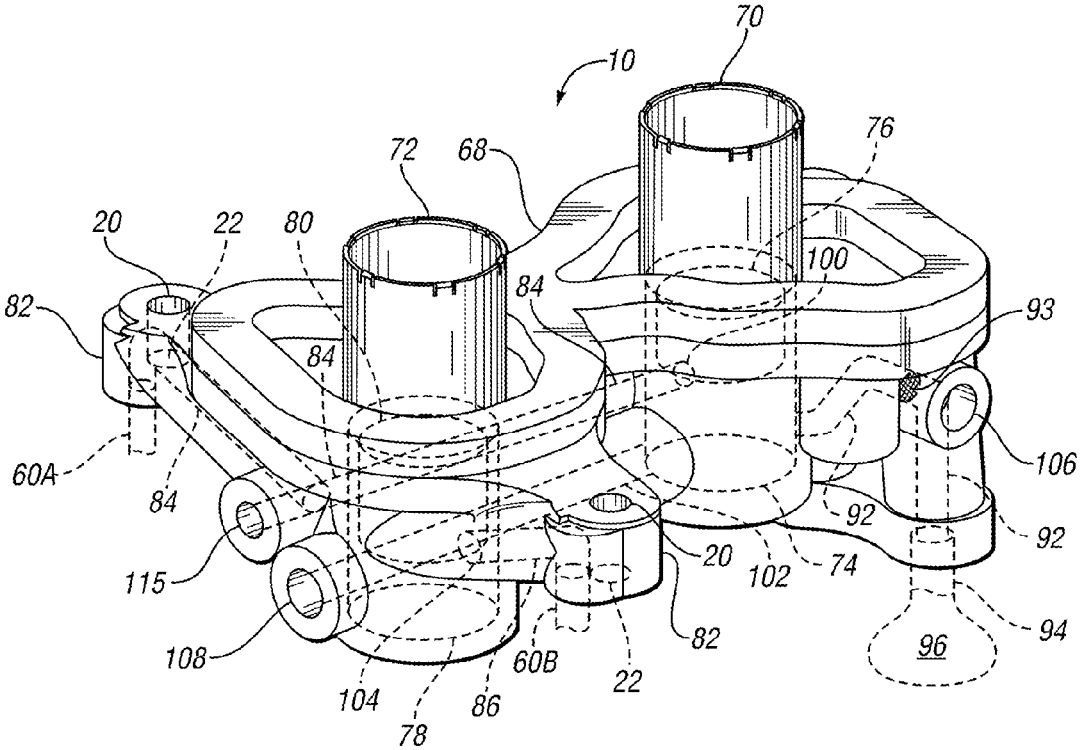
FIG. 2 is a schematic perspective illustration of the single hydraulic circuit module of FIG. 1.

Referring now to FIG. 2, the single hydraulic circuit module 10 will be described in greater detail. Module 10 includes a housing 68 which is preferably cast and includes a plurality of fluid passages described herein. The fluid passages are formed or machined in the housing 68. The housing 68 supports a first solenoid valve 70 as well as a second solenoid valve 72. The housing 68 is formed with a first chamber 74 in which a valve body 76 of the first solenoid valve 70 is selectively translatable in response to hydraulic fluid pressure within the chamber 74. The housing 68 also forms a second chamber 78 which houses a second valve body 80 of the second solenoid valve 72. The second valve body 80 is translatable in response to hydraulic fluid pressure within the chamber 78.

The housing 68 is formed with flanges 82, two of which are visible in FIG. 2 and all three of which are visible in FIG. 1. The two flanges 82 visible in FIG. 2 are formed with the fastener openings 20 that, when aligned with mating engine openings 22, will allow the single hydraulic circuit module 10 to be attached to the cylinder head 12. Two of the flanges 82 visible in FIG. 2 also partially house a first control passage 84 and a second control passage 86. When the module 10 is attached to the cylinder head 12, the first control passage 84 aligns with a first feed passage 60A formed in the cylinder head 12. The first feed passage 60A allows hydraulic fluid at a controlled pressure to be supplied to a first set of engine valves, as will be described herein. The second control passage 86 is in fluid communication with a second feed passage 60B also formed in the cylinder head 12 which is in fluid communication with the second set of engine valves as will be described herein. An additional flange 82 (which does not house a fastener opening 20), is also formed on the housing 68 and partially houses a supply passage 92 which, when the module 10 is attached to the cylinder head 12, aligns with a fluid supply passage 94 formed in the cylinder head 12 which, in turn, is in fluid communication with a fluid supply gallery 96 formed in the engine, and shown in phantom in FIG. 2. Those skilled in the art will readily understand the fluid supply gallery 96 formed in the engine to be a portion of the cast engine to which hydraulic fluid flows. Fluid may be supplied to the fluid supply passage 92 from the supply passage 94 and gallery 96 via a pump (not shown). A filter 93 is schematically shown positioned in the supply passage 92 to filter debris that might otherwise be carried from the supply gallery 96 downstream to the chambers 74 and 78.

The fluid supply passage 92 has a worm-like configuration that is in fluid communication with a portion of the first chamber 74 beneath the valve body 76. The first control passage 84 is also formed within the housing 68 and includes a transverse portion positioned opposite the first and second solenoid valves 70, 72 with respect to the supply passage 92 and the second control passage 86. The transverse portion of the first control passage 84 is positioned to be in fluid communication with the chamber 74 opposite the supply passage 92. The valve body 76 is sized to selectively partially interfere with the first control passage 84. Specifically, when fluid is supplied through the supply passage 92 at a first, relatively low pressure, the valve body 76 is pushed upward to only partially obscure an opening 100 of the first control passage 84 at the chamber 74. Thus, fluid is able to flow to the first control passage 84 at a first flow volume. The fluid then flows to the first feed passage 60A in the cylinder head 12 to be directed to a first set of hydraulic lift assemblies as will be described below.

The supply passage 92 includes an intermediate portion 102 formed between the first chamber 74 and the second chamber 78 and in fluid communication therewith. Thus, fluid in the supply passage 92 is supplied to the second chamber 78 via the first chamber 74 and the intermediate portion of the supply passage 102. The fluid that collects in the second chamber 78 is of sufficient pressure to lift the second valve body 80 such that it only partially interferes with an opening 104 of second control passage at the chamber 78. Thus, a first fluid flow is provided through the second control passage 86 to the second feed passage 60B of the cylinder head 12 to be directed to a second set of hydraulic lift assemblies as will be described below.

The solenoids 70, 72 are preferably electronically controlled by an electronic control unit (not shown) to translate the valve bodies 76, 80 within the respective chambers 74, 78.

First supply passage opening 106, second supply passage opening 108 and opening 115 of first control passage 84 are plugged after the supply passages 92, 102 are drilled in the module 10. Exhaust passages (not shown) are also provided in fluid communication with each of the chambers 74, 78 to drain excess fluid back to the engine fluid supply.

When the solenoid valves 70, 72 are controlled to position the valve bodies 76, 80 such that the control passages 84, 86 are accessible to provide a first amount of fluid flow, the first and second sets of hydraulic lift assemblies respectively controlled via passages 84 and 86 and feed passages 60A and 60B lift engine valves a first predetermined amount, that is a relatively low lift level. When a higher level of valve lift is desired, the first and second solenoid valves 70, 72 are controlled by the electronic control unit (not shown) to lift respective valve bodies 76, 80 to allow unobstructed flow through the openings 100, 104 of the respective control passages 84, 86. Thus, fluid is provided at a second, higher pressure level through the first and second control passages 84, 86 and respective feed channels 60A, 60B to the first and second sets of hydraulic lift assemblies to cause a second, higher predetermined amount of engine valve lift.

Referring again to FIG. 1, the single hydraulic circuit module 10 is attached between spark plug towers 110 of adjacent engine cylinders. Specifically, the cylinder head 12 partially forms six separate cylinders 112A, 112B, 112C, 112D, 112E and 112F, which may be referred to as the first through sixth cylinders, or cylinders 1-6 respectively. The single hydraulic circuit module 10 is positioned between the spark plug towers 110 of the third and fourth cylinders, 112C and 112D. When the intake and exhaust camshafts are installed to rotate about the axes 24 and 26, respectively, the module 10 is positioned below the camshafts. Electrical connector portions of the solenoid valves 70, 72 are positioned near the upper ends of the valves 70, 72 to be easily accessible for connection to a wiring harness and/or electronic control unit. When the module 10 is attached to the cylinder head 12, the supply passage 92 is aligned with a fluid supply gallery positioned therebelow, as shown by gallery 96 in FIG. 2. The first control passage 84 aligns with the first feed passage 60A. The first feed passage 60A is in fluid communication with a hydraulic lash adjuster identical to hydraulic lash adjuster 32 of FIG. 3 at each of the first, second and third cylinders, 112A, 112B and 112C. Similarly, the second control passage 86 is aligned with a second feed passage 60B which is placed in fluid communication with hydraulic lash adjusters such as those described with respect to FIG. 3 for cylinders 4, 5 and 6 (112D, 112E and 112F), with the second feed passage 60B being operatively connected with respect to the hydraulic lash adjuster similar to the operative connection of hydraulic lash adjuster 32 with feed passage 60A as shown in FIG. 3.

Thus, the single hydraulic circuit module 10 allows lift control of multiple engine valves. In fact two sets of multiple engine valves are controlled by module 10, the first set being engine valves located at cylinders 1 through 3 (112A, 112B and 112C), and the second set being engine valves located at cylinders 4 through 6 (112D, 112E and 112F). By removing the supply passage 92 and control passages 84 and 86 from the cylinder head 12 and instead packaging them in control module 10, control of multiple valves is afforded while reducing the complexity of the cylinder head 12. Additionally, the module 10 may be preassembled and tested prior to attachment to the cylinder head.

Figure 4:
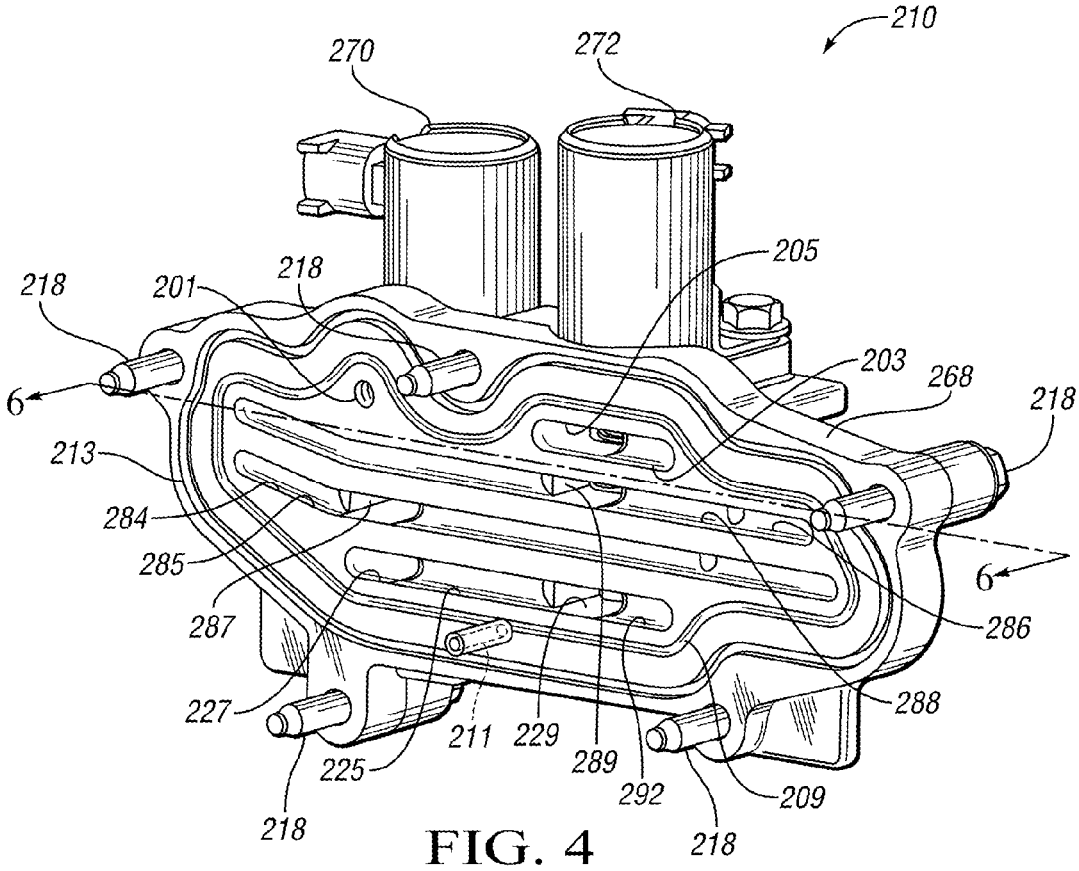
FIG. 4 is a schematic perspective illustration of a second embodiment of a single hydraulic circuit module for controlling lift of an engine valve such as that of FIG. 3.
Figure 5:
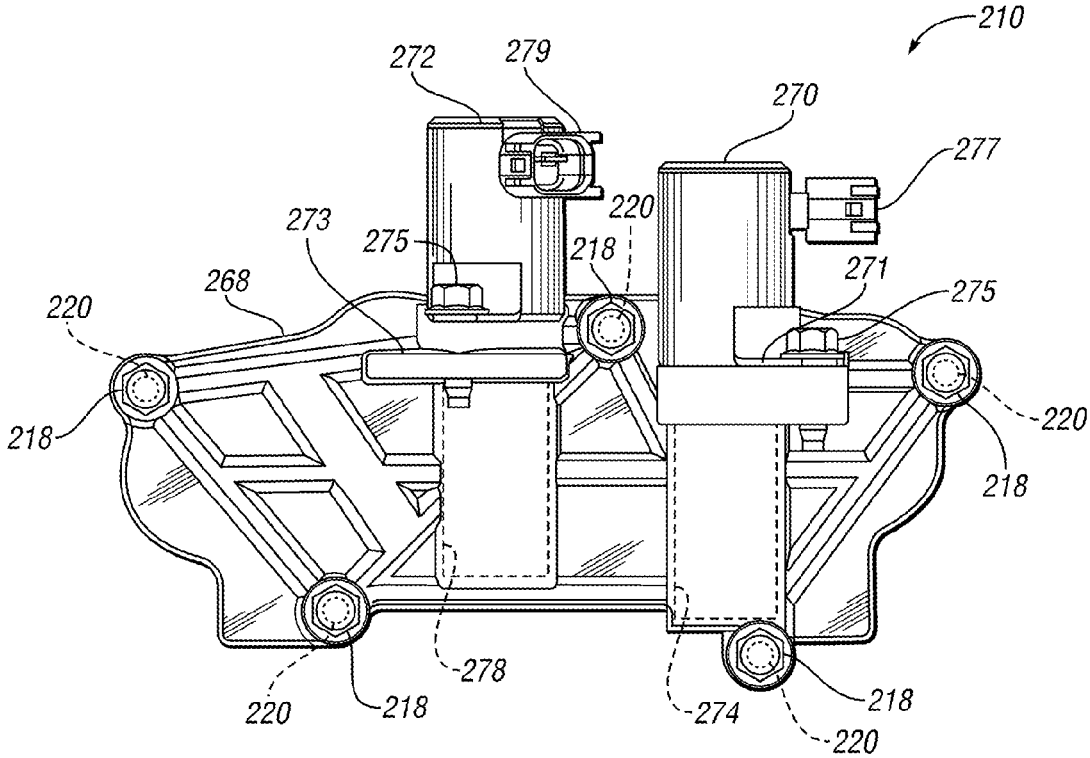
FIG. 5 is a schematic illustration in elevational view of the single hydraulic circuit module of FIG. 4.
Figure 6:
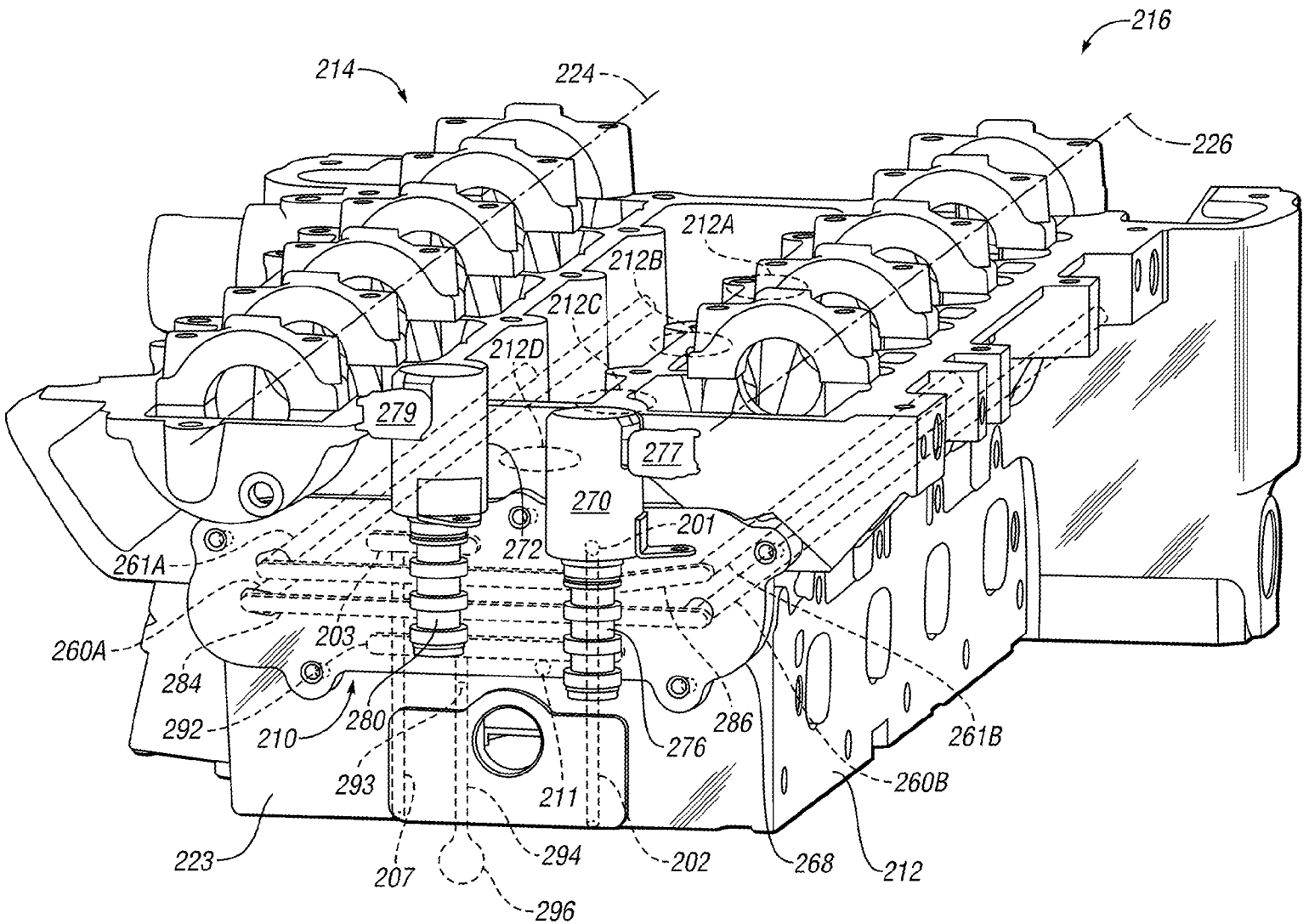
FIG. 6 is a schematic perspective illustration of a portion of an engine assembly having the single hydraulic circuit module of FIGS. 4 and 5 (shown partially in phantom and in cross-section at the arrows shown in FIG. 4) attached at a side surface of a cylinder head.

Referring to FIG. 4, a second embodiment of a single hydraulic circuit module 210 will now be described. The module 210 includes a housing 268 which supports first and second solenoid valves 270, 272, respectively. As shown in FIG. 5, the solenoid valves 270, 272 are supported on first and second flanges 271, 273 of housing 268, which secure the valves 270, 272 via valve bolts 275. The housing 268 also forms first and second chambers 274, 278 respectively. The first chamber 274 houses the first solenoid valve body 276 which is visible in FIG. 6. The second chamber 278 houses the second solenoid valve body 280, also visible in FIG. 6. Referring again to FIG. 5, the housing 268 has bolt openings 220 which allow the housing 268 to be connected to a cylinder head 212 as illustrated in FIG. 6 via bolts 218. When assembled, electrical connector portions 277, 279 of the respective solenoid valves 270, 272 are accessible above the housing 268.

Referring now to FIG. 4, the housing 268 is preferably a cast member that forms a supply passage 292. Supply passage 292 includes a fluid supply channel 225 as well as a first supply aperture 227 and a second supply aperture 229. The supply apertures 227 and 229 extend through the housing 268. Referring to FIG. 6, which shows the housing 268 taken in partial cross-sectional view at the arrows shown in FIG. 4, when the supply module 210 is mounted to the cylinder head 212, the fluid supply passage 292 is in fluid communication with a supply channel 294 in the cylinder head 212 that communicates with a fluid supply gallery 296 in the engine block (not shown) to which the cylinder head 212 is designed to be attached to form a completed engine assembly 216. Thus, fluid is provided through the fluid supply channel 294 to the fluid supply passage 292 and through the respective fluid supply apertures 227 and 229 to the solenoid valve bodies 276 and 280.

Referring again to FIG. 4, the housing 268 also forms a first control passage 284 that includes a first control channel 285 as well as a first control aperture 287. The first control aperture 287 extends through the housing 268 and is in fluid communication with the first chamber 274.

The housing 268 also is formed with a second control passage 286 which includes a second control channel 288 as well as a second control aperture 289. The second control aperture 289 extends through the housing 268 in fluid communication with the second control chamber 278 (shown in FIG. 5).

Referring to FIG. 6, the first control passage 284 is in fluid communication with the first valve body 276 through the first control aperture 287, and with the first intake valve feed passage 260A formed in the cylinder head 212, which is aligned with the first control passage 284 when the housing 268 is bolted to the cylinder head 212. The first control passage 284 also aligns with a first exhaust valve feed passage 260B provided in the cylinder head 212. The second control passage 286 is in fluid communication with the second valve body 280 through the second control aperture 289 and is in fluid communication with the second intake valve feed passage 261A and a second exhaust valve feed passage 261B, both of which are provided in the cylinder head 212.

The cylinder assembly 214 is an overhead cam-type with an intake camshaft (not shown) that rotates about an intake camshaft axis 224 and an exhaust camshaft that rotates about an exhaust camshaft axis 226. The cylinder head 212 partially forms four cylinders indicated schematically by upper ends thereof. The cylinders include a first cylinder 212A, a second cylinder 212B, a third cylinder 212C and a fourth cylinder 212D. The first intake feed passage 260A routes through the cylinder head 212 to the vicinity of the first and second cylinders 212A, 212B to provide hydraulic fluid to hydraulic lift assemblies located adjacent cylinders to cause lift of engine inlet valves as described with respect to the valve train, including hydraulic lash adjuster 32, SRFF assembly 30 and engine inlet valve 36, of FIG. 3.

The second intake valve feed passage 261A is routed through the cylinder head 212 to allow fluid communication with hydraulic lift assemblies positioned to cause lift of engine inlet valves for cylinders 3 and 4, 212C and 212D, respectively.

Similarly, the first exhaust feed passage 260B routes through the cylinder head 212 to provide hydraulic fluid pressure to hydraulic lift assemblies positioned to cause lift of engine exhaust valves located at cylinders 1 and 2, 212A, 212B, respectively. The second exhaust feed passage 261B routes through the cylinder head 212 to allow fluid communication with hydraulic lift assemblies positioned to cause lift of engine exhaust valves at cylinders 212C and 212D. Cylinders 1 and 2 are a first set of cylinders having a first set of hydraulic lift assemblies (either for engine intake valves or engine exhaust valves) associated therewith. Cylinders 3 and 4 are a second set of cylinders having a second set of hydraulic lifters valves (either for engine intake valves or engine exhaust valves) operatively associated therewith and connected thereto.

As shown in FIG. 6, the first and second solenoid valve bodies 276, 280 are positioned between the fluid supply passage 292 and the respective first and second control passages 284, 286 to partially block fluid flow to the respective chambers 274, 278 (shown in FIG. 5), thus permitting only a first, relatively low level of hydraulic fluid flow and associated pressure to the respective control passages 284, 286. Accordingly, when controlled to be in such a position, the valve bodies 276 and 280 allow only a first level of fluid flow to the respective hydraulic lift assemblies of the first and second cylinders sets 212A-212B, 212C-212D, respectively. However, an electronic control unit (not shown) controls the solenoid valves 270, 272 to allow the valve bodies 276, 280 to translate within the chambers 274, 278 so that a greater level of fluid flow, and thus fluid pressure, is provided from the supply passage 292 to the respective first and second control passages 284, 286. Those skilled in the art will readily understand the use of an electronic control unit to shift the position of a solenoid valve body to change fluid flow permitted past the valve body. It should be appreciated that the solenoid valves 270, 272 may be controlled separately from one another to allow a low pressure or high pressure flow situation independently of the other valve. Alternatively, the solenoid valves 270, 272 may be controlled to simultaneously switch from low flow to high flow, or vice versa. Thus, by controlling the solenoid valves 270, 272 fluid flow and associated pressure to the respective cylinder sets 212A-212B, 212C-212D is controlled to allow a low lift or high lift of associated engine inlet valves or exhaust valves of each respective set. A single hydraulic circuit module 210 thus controls inlet and exhaust valves on four cylinders.

The housing 268 is bolted to an outer surface 223 which in this case is a side of the cylinder head 212. As used herein "side" means an outer surface of the cylinder head 212 that is generally parallel with the cylinders 212A, 212D. The side 223 in FIG. 6 is positioned rearward when the engine assembly 216 is packaged in a vehicle. When the housing 268 is connected to the cylinder head 212, the electrical connected portions 277 and 279 of the respective solenoid valves 270, 272 are easily accessible for testing, repair, and connection to an electronic control unit, as can be seen in FIG. 6.

Referring again to FIG. 4, other features of the single hydraulic circuit module 212 will now be described. A filter 293 may be positioned in fluid communication with the supply channel 294 to prevent debris from entering the module 210. Housing 268 incorporates means for exhausting each of the solenoid valves 270, 272. An exhaust passage 201 extends through the housing 268 in communication with an upper region of the first chamber 274 shown in FIG. 5. Thus, fluid exhaust from the first solenoid valve 270 is provided through the exhaust passage 201. As illustrated in FIG. 6, the exhaust passage 201 is in fluid communication with a drain passage 202 formed in the cylinder head 212 for draining the first solenoid 270. Similarly, an exhaust passage 203 is formed in the housing 268 (see FIG. 4) and includes an aperture 205 extending through the housing 268 to an upper region of the second chamber 278 of the second solenoid valve 272. As illustrated in FIG. 6, when the housing 268 is secured to the cylinder head 212, the exhaust passage 203 is in fluid communication with a drain passage 207 formed in the cylinder head 212 for draining the second solenoid valve 272. Drain passages 202 and 207 formed in the cylinder head 212 are routed to a drain portion of an engine block when the cylinder 212 is connected to the engine block.

Referring again to FIG. 4, the housing 268 is formed with a weep channel 209 which circumscribes and is shallower depth than the fluid supply channel 225 and the first and second control passages 284 and 286. The weep channel 209 collects any fluid that may seep between the housing 268 and the outer surface 223 (see FIG. 6) of the cylinder head 212. The collected fluid is directed through a weep channel drain 211 to the inside of the cylinder head 212 for drainage back to an engine block when the engine block is connected to the cylinder head 212.

A gasket 213 circumscribes the weep channel 211, the supply channel 225, the first and second control passage 284, 286 and the exhaust passages 201 and 203. The gasket 213 ensures an adequate seal between the module 210 and the cylinder head 212.

While the best modes for carrying out the invention have been described in detail, those familiar with the art to which this invention relates will recognize various alternative designs and embodiments for practicing the invention within the scope of the appended claims.

The invention claimed is:

1. An apparatus for an engine assembly having a cylinder head, wherein the cylinder head at least partially forms a plurality of cylinders and supports at least one hydraulic lift assembly for each of said cylinders and is in fluid communication with a hydraulic fluid supply gallery, the apparatus comprising:

a solenoid valve;

a housing supporting said solenoid valve and at least partially forming a fluid supply passage and a control passage, wherein said solenoid valve is positioned between said passages and is controllable to vary fluid flow from said fluid supply passage to said control passage;

wherein said housing is configured for attachment to said cylinder head such that said fluid supply passage is in fluid communication with said fluid supply gallery and said control passage is in fluid communication with the hydraulic lift assemblies for a first set of said cylinders;

a gasket circumscribing said fluid supply channel and said control passage for sealing said apparatus when said apparatus is attached to said cylinder head; and a weep channel formed on a surface of said housing and circumscribing said fluid supply passage and said control passage and being circumscribed by said gasket.

2. The apparatus of claim 1, further comprising:

a filter positioned in said supply passage upstream of said at least one solenoid valve.

3. The apparatus of claim 1, wherein said housing forms a chamber configured to receive said solenoid valve; and wherein said supply passage and said control passage each include a channel formed on an outer surface of said housing and an aperture extending through said channel in fluid communication with said chamber.

4. The apparatus of claim 1, wherein said solenoid valve is a first solenoid valve, said control passage is a first control passage, and further comprising:

a second solenoid valve; wherein said housing supports said second solenoid valve and at least partially forms a second control passage; wherein said second solenoid valve is positioned between said fluid supply passage and said second control passage and is controllable to vary fluid flow from said fluid supply passage to said second control passage; and wherein said second control passage is in fluid communication with the hydraulic lift assemblies for a second set of the cylinders when said housing is attached to said cylinder head, said second set not including any cylinders in said first set of cylinders.

5. An engine assembly comprising:

a cylinder head in fluid communication with a hydraulic fluid supply and at least partially forming a plurality of cylinders;

first and second sets of hydraulic lift assemblies operatively connected to first and second sets of said cylinders, respectively, and responsive to a variation in hydraulic fluid flow to cause a variation in lift of first and second sets of engine valves respectively operatively connected thereto; wherein each of said sets of hydraulic lift assemblies includes multiple hydraulic lift assemblies;

wherein said cylinder head has a feed passage in fluid communication with each hydraulic lift assembly of said first set of hydraulic lift assemblies; and a single hydraulic circuit module connected to an outer surface of said cylinder head and having:

a housing that at least partially forms a supply passage and a control passage, wherein said supply passage is in fluid communication with said fluid supply and said control passage is in fluid communication with and upstream of said feed passage; and a solenoid valve supported by said housing and positioned between said supply passage and said control passage and controllable to vary flow from said supply passage to said control passage;

said single hydraulic circuit module thereby permitting variable lift of said engine valves operatively connected to said first set of hydraulic lift assemblies in response to control of said solenoid valve.

6. The engine assembly of claim 5, further comprising:

a rotatable overhead camshaft operatively connected with said first set of hydraulic lift assemblies to cause reciprocal lifting and lowering of said first set of engine valves in response to rotation of said camshaft.

7. The internal combustion engine of claim 5, wherein said feed passage is a first feed passage, said control passage is a first control passage and said solenoid is a first solenoid; wherein said cylinder head has a second feed passage in fluid communication with said second set of hydraulic lift assemblies; wherein said housing at least partially forms a second control passage upstream of said second feed passage; and further comprising:

a second solenoid valve supported by said housing and positioned between said supply passage and said second control passage and controllable to vary fluid flow from said supply passage to said second control passage;

said single hydraulic circuit module thereby permitting variable lift of said second set of engine valves operatively connected to said second set of hydraulic lift assemblies in response to control of said second solenoid valve and independently of said first set of said engine valves operatively connected to said first set of hydraulic lift assemblies.

8. The engine assembly of claim 7, further comprising:

a rotatable overhead camshaft operatively connected with at least one of said first set and said second set of hydraulic lift assemblies to cause reciprocal lifting and lowering of said respective one of said first set and said second set of engine valves in response to rotation of said camshaft.

9. The engine assembly of claim 8, wherein said rotatable overhead camshaft is operatively connected with both said first set and said second set of hydraulic lift assemblies to cause reciprocal lifting and lowering of both said first set and said second set of engine valves in response to rotation of said camshaft.

10. The engine assembly of claim 8, wherein said rotatable overhead camshaft is a first overhead camshaft operatively connected with said first set of hydraulic lift assemblies, and further comprising:

a second overhead camshaft operatively connected with said second set of hydraulic lift assemblies, wherein said first set of engine valves are intake valves and said second set of engine valves are exhaust valves.

11. The engine assembly of claim 5, wherein said single hydraulic circuit module is attached to said cylinder head between adjacent ones of said cylinders.

12. The engine assembly of claim 5, wherein said single hydraulic circuit module is attached to said cylinder head on a side thereof.

13. A cylinder head assembly for an engine comprising:

a cylinder head in fluid communication with a fluid supply gallery and at least partially forming a plurality of cylinders;

first and second sets of engine valves operatively connected to first and second sets of said cylinders, respectively, and responsive to a variation in hydraulic pressure within first and second sets of hydraulic lift assemblies to cause a variation in engine valve lift;

a rotatable overhead camshaft operatively connected with at least one of said first set and said second set of engine valves to cause reciprocal lifting and lowering thereof in response to rotation of said camshaft;

wherein said cylinder head has a first feed passage in fluid communication with each hydraulic lift assembly of said first set of hydraulic lift assemblies and a second feed passage in fluid communication with each hydraulic lift assembly of said second set of hydraulic lift assemblies; and a single hydraulic circuit module connected to an outer surface of said cylinder head and having:

a housing that at least partially forms a supply passage, a first control passage and a second control passage, wherein said supply passage is in fluid communication with said fluid supply gallery, said first control passage is in fluid communication with and upstream of said first feed passage, and said second control passage is in fluid communication with and upstream of said second feed passage;

a first solenoid valve supported by said housing, positioned between said supply passage and said first control passage and controllable to vary fluid flow from said fluid supply passage to said first control passage; and a second solenoid valve supported by said housing, positioned between said supply passage and said second control passage and controllable to vary fluid flow from said fluid supply passage to said second control passage;

said single hydraulic circuit module thereby permitting variable lift of said first and second sets of engine valves in response to control of said first and second solenoid valves, respectively.

* * * * *